US009455499B2

(12) United States Patent
Wong et al.

(10) Patent No.: US 9,455,499 B2
(45) Date of Patent: Sep. 27, 2016

(54) COMMUNICATION DEVICE AND ANTENNA ELEMENT THEREIN

(71) Applicant: Acer Incorporated, New Taipei (TW)

(72) Inventors: Kin-Lu Wong, New Taipei (TW); Meng-Ting Chen, New Taipei (TW)

(73) Assignee: ACER INCORPORATED, New Taipei (TW)

( * ) Notice: Subject to any disclaimer, the term of this patent is extended or adjusted under 35 U.S.C. 154(b) by 317 days.

(21) Appl. No.: 13/963,415

(22) Filed: Aug. 9, 2013

(65) Prior Publication Data

US 2014/0320359 A1 Oct. 30, 2014

(30) Foreign Application Priority Data

Apr. 25, 2013 (TW) ..... 102114762 A

(51) Int. Cl.

| | |
|---|---|
| ***H01Q 1/50*** | (2006.01) |
| ***H01Q 9/30*** | (2006.01) |
| ***H01Q 9/42*** | (2006.01) |
| ***H01Q 5/35*** | (2015.01) |

(52) U.S. Cl.
CPC ..... *H01Q 9/30* (2013.01); *H01Q 5/35* (2015.01); *H01Q 9/42* (2013.01)

(58) Field of Classification Search
USPC ..... 343/852, 857, 858
See application file for complete search history.

(56) References Cited

U.S. PATENT DOCUMENTS

| | | | |
|---|---|---|---|
| 8,330,657 | B2 | 12/2012 | Liu |
| 2005/0104783 | A1 | 5/2005 | Kojima |
| 2006/0142075 | A1 | 6/2006 | Jang et al. |
| 2009/0251383 | A1 | 10/2009 | Tani et al. |

FOREIGN PATENT DOCUMENTS

| | | | |
|---|---|---|---|
| CN | 1653645 | | 8/2005 |
| CN | 1965445 | A | 5/2007 |
| CN | 101453048 | | 6/2009 |
| CN | 102005640 | A | 4/2011 |
| JP | 2006310995 | A | 11/2006 |
| WO | 2011055003 | A1 | 5/2011 |
| WO | WO 2012/001729 | | 1/2012 |

OTHER PUBLICATIONS

CN Office Action dated Dec. 10, 2015 in corresponding Chinese application (No. 201310155557.8).

Chinese language office action dated Jul. 7, 2015, issued in application No. TW 102114762.

Chinese language office action dated Apr. 5, 2016, issued in application No. CN 201310155557.8.

*Primary Examiner* — Graham Smith
(74) *Attorney, Agent, or Firm* — McClure, Qualey & Rodack, LLP

(57) ABSTRACT

A communication device including a ground element and an antenna element is provided. The antenna element includes a metal element. The metal element is disposed at or adjacent to an edge of the ground element. The metal element is substantially perpendicular to the ground element. The metal element has a projection on the ground element, and the whole projection is in the internal of the ground element. The antenna element has a first feeding point and a second feeding point. The first and second feeding points are away from each other. The first and second feeding points are substantially positioned at two ends of the metal element, respectively. The first feeding point is coupled through a first switch and a first matching circuit to a communication module. The second feeding point is coupled through a second switch and a second matching circuit to the communication module.

11 Claims, 7 Drawing Sheets

COMMUNICATION DEVICE AND ANTENNA ELEMENT THEREIN

CROSS REFERENCE TO RELATED APPLICATIONS

This Application claims priority of Taiwan Patent Application No. 102114762 filed on Apr. 25, 2013, the entirety of which is incorporated by reference herein.

BACKGROUND OF THE INVENTION

1. Field of the Invention

The disclosure generally relates to a communication device, and more particularly, relates to a communication device comprising a reconfigurable dual-feed antenna element.

2. Description of the Related Art

Recently, mobile communication devices are demanded to support more and more functions in order to meet the requirements of the consumers. Furthermore, mobile communication devices with a slim profile are becoming very attractive for the consumers. Accordingly, some communication devices use metal back covers to provide a slim or thin appearance. However, such metal back covers may cause strong effects on the performances of the internal antennas inside the communication devices. It hence becomes a great challenge for antenna engineers to design the internal antennas inside the communication devices to support multiple functions of wireless communication services and to attain good communications quality.

BRIEF SUMMARY OF THE INVENTION

The invention is aimed to provide a communication device comprising a metal back cover and a reconfigurable dual-feed antenna element therein. The antenna element has advantages of being small in size and having a low profile. In a preferred embodiment, the antenna element at least covers the LTE/WWAN (Long Term Evolution/Wireless Wide Area Network) bands.

In a preferred embodiment, the invention provides a communication device comprising a ground element and an antenna element. The antenna element comprises a metal element, wherein the metal element is disposed at or adjacent to an edge of the ground element, the metal element is substantially perpendicular to the ground element, the metal element has a projection on the ground element, the whole projection is in the internal of the ground element, the antenna element has a first feeding point and a second feeding point, the first feeding point and the second feeding point are away from each other and are respectively substantially positioned at a first end and a second end of the metal element, and the first feeding point and the second feeding point are both adjacent to the edge of the ground element, wherein the first feeding point is coupled through a first switch and a first matching circuit to a communication module, and the second feeding point is coupled through a second switch and a second matching circuit to the communication module.

In some embodiments, the metal element has a planar structure and substantially has an inverted U-shape. In some embodiments, the metal element has a smoothly-bent structure and substantially has an inverted C-shape. In some embodiments, when the first switch is closed and the second switch is open, the antenna element is fed from the first feeding point. The first matching circuit provides a first impedance value such that the antenna element operates in a first band. A length of the metal element is smaller than 0.15 wavelength of the lowest frequency in the first band. Since the length of the metal element is much smaller than 0.25 wavelength required for a conventional antenna element, the antenna element of the invention has an advantage of being small in size. In some embodiments, when the second switch is closed and the first switch is open, the antenna element is fed from the second feeding point. The second matching circuit provides a second impedance value such that the antenna element operates in a second band. In some embodiments, frequencies of the second band are higher than frequencies of the first band. In some embodiments, the first band is approximately from 824 MHz to 960 MHz, and the second band is approximately from 1710 MHz to 2690 MHz.

In some embodiments, the antenna element further has a third feeding point. The third feeding point is positioned between the first feeding point and the second feeding point. The third feeding point is coupled through a third switch and a third matching circuit to the communication module. In some embodiments, when the first switch and the second switch are both open and the third switch is closed, the antenna element is fed from the third feeding point. The third matching circuit provides a third impedance value such that the antenna element operates in a third band. In some embodiments, the third band is adjacent to the first band or is between the first band and the second band. In some embodiments, the third band is approximately from 704 MHz to 787 MHz.

In some embodiments, the ground element is substantially disposed between a metal back cover of the communication device and the metal element of the antenna element such that the antenna element is substantially not affected by the metal back cover. Accordingly, the communication device of the invention can attain good communications quality.

In some embodiments, the antenna element has a planar structure, and an area of the antenna element is only about 112 $mm^2$ (8 mm by 14 mm) (a height of the antenna element on the ground element is only about 8 mm). For such a design, the antenna element is capable of switching between the GSM850/900 bands at lower frequencies and the GSM1800/1900/UMTS/LTE2300/2500 bands at higher frequencies. That is, the antenna element of the invention at least covers the WWAN/LTE bands which are approximately from 824 MHz to 960 MHz and from 1710 MHz to 2690 MHz.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the foregoing and other purposes, features and advantages of the invention, the embodiments and figures thereof in the invention are described in detail as follows.

Figure 1:
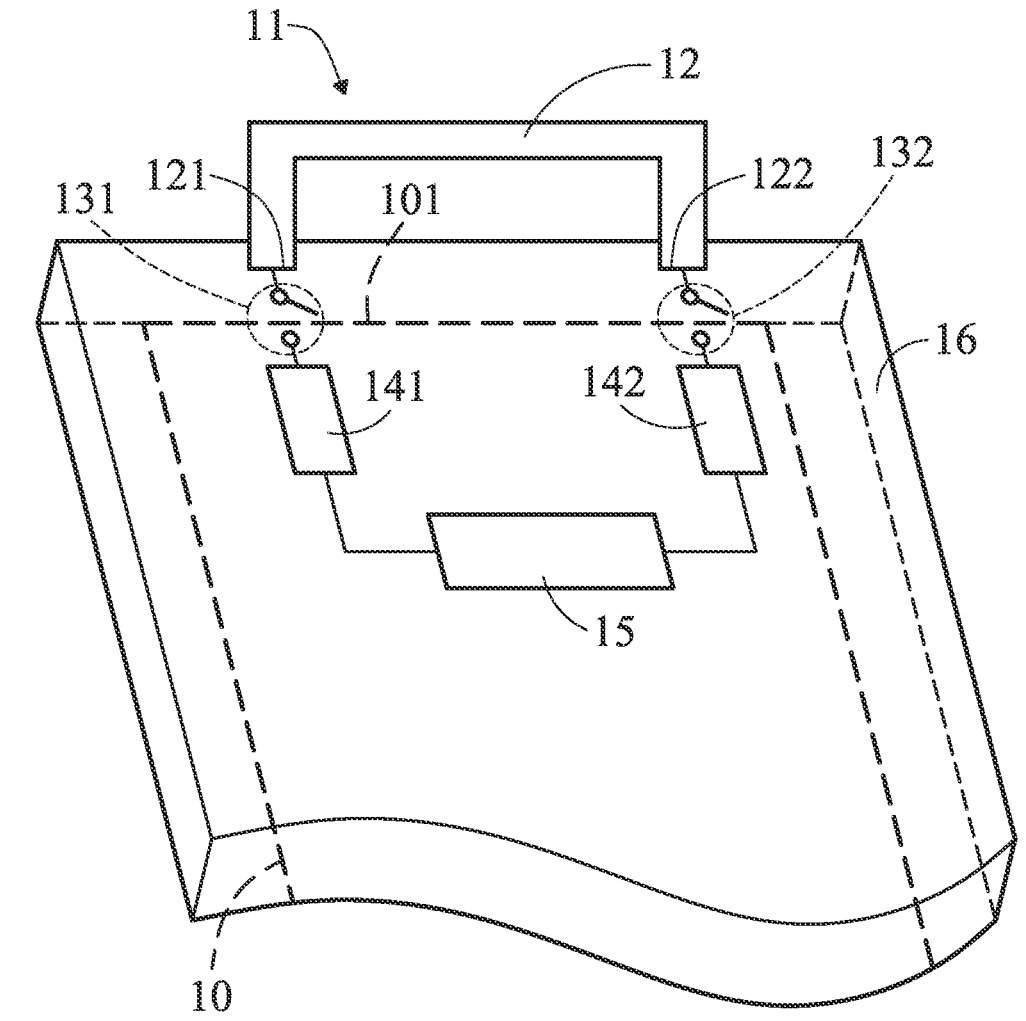
FIG. 1 is a diagram for illustrating a communication device according to a first embodiment of the invention.

FIG. 1 is a diagram for illustrating a communication device 100 according to a first embodiment of the invention. The communication device 100 may be a smartphone, a tablet computer, or a notebook computer. As shown in FIG. 1, the communication device 100 at least comprises a ground element 10 and an antenna element 11. The antenna element 11 comprises a metal element 12. The metal element 12 is disposed at or adjacent to an edge 101 of the ground element 10. The metal element 12 is substantially perpendicular to the ground element 10. More particularly, if the ground element 10 is disposed on a first plane and the metal element 12 is disposed on a second plane, the first plane may be substantially perpendicular to the second plane. The metal element 12 has a projection on the ground element 10, and the whole projection is in the internal of the ground element 10. In some embodiments, the metal element 12 has a planar structure and substantially has an inverted U-shape. The antenna element 11 has a first feeding point 121 and a second feeding point 122. The first feeding point 121 and the second feeding point 122 are away from each other, and are respectively substantially positioned at a first end and a second end of the metal element 12. In addition, the first feeding point 121 and the second feeding point 122 are both adjacent to the edge 101 of the ground element 10.

In some embodiments, the communication device 100 further comprises a first switch 131, a second switch 132, a first matching circuit 141, a second matching circuit 142, a communication module 15, and a dielectric substrate 16. The types of the first switch 131 and the second switch 132 are not limited in the invention. For example, each of the first switch 131 and the second switch 132 is implemented with a PIN diode. The first matching circuit 141 provides a first impedance value, and the second matching circuit 142 provides a second impedance value. The first impedance value may be different from the second impedance value. In some embodiments, each of the first matching circuit 141 and the second matching circuit 142 comprises one or more inductors and capacitors, such as chip inductors and chip capacitors. The communication module 15 is considered as a signal source of the antenna element 11. The first feeding point 121 of the antenna element 11 is coupled through the first switch 131 and the first matching circuit 141 to the communication module 15. The second feeding point 122 of the antenna element 11 is coupled through the second switch 132 and the second matching circuit 142 to the communication module 15. By controlling the first switch 131 and the second switch 132, the antenna element 11 selects either the first feeding point 121 or the second feeding point 122 to couple to the communication module 15 to operate in different bands. In some embodiments, the communication device 100 further comprises a control unit (not shown). The control unit selectively closes and opens any of the first switch 131 and the second switch 132 according to a user input signal or a detection signal. In some embodiments, the communication device 100 further comprises a sensor (not shown). The sensor detects a frequency of an electromagnetic signal nearby and accordingly generates the detection signal. Note that the communication device 100 may further comprise other components, such as a touch panel, a processor, a speaker, a battery, and a housing (not shown).

Figure 2:
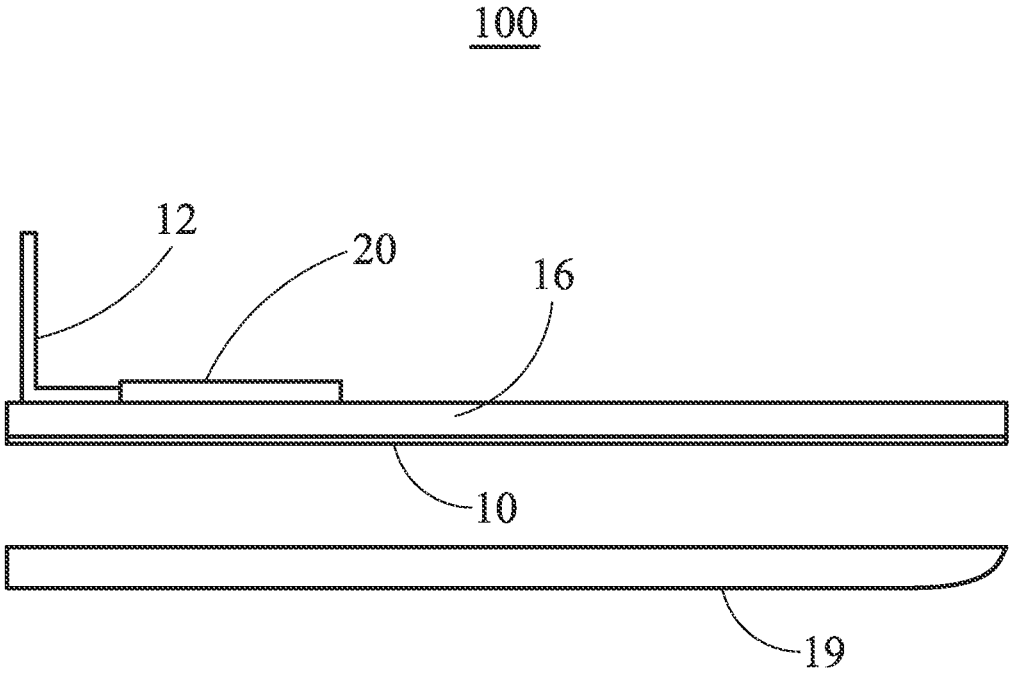
FIG. 2 is a side view for illustrating a communication device according to a first embodiment of the invention.

FIG. 2 is a side view for illustrating the communication device 100 according to the first embodiment of the invention. As shown in FIG. 1 and FIG. 2, the metal element 12 is substantially perpendicular to the ground element 10. The metal element 12 and a compound module 20 (comprising the first switch 131, the second switch 132, the first matching circuit 141, the second matching circuit 142, and the communication module 15 that are mentioned above) are disposed on a first surface of the dielectric substrate 16, and the ground element 10 is disposed on a second surface of the dielectric substrate 16. The first surface is opposite to the second surface. In some embodiments, the communication device 100 further comprises a metal back cover 19 which is a portion of a housing (not shown) of the communication device 100. Since the ground element 10 is substantially disposed between the metal back cover 19 and the metal element 12 of the antenna element 11, the metal element 12 of the antenna element 11 is substantially not affected by the metal back cover 19. Accordingly, the antenna element 11 of the invention is suitably applied to a communication device with a metal back cover to attain good radiation performance.

Figure 3:
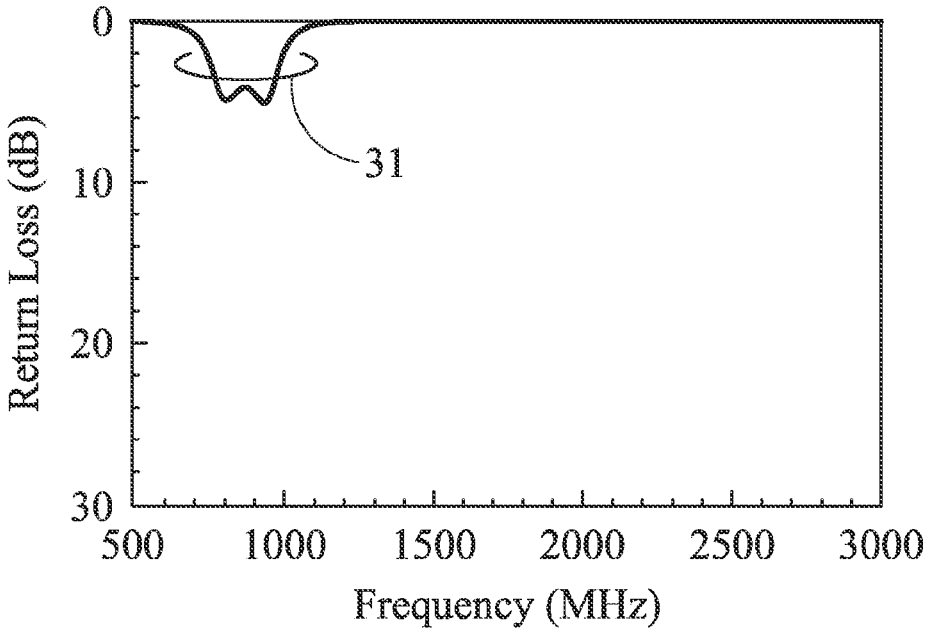
FIG. 3 is a diagram for illustrating return loss of an antenna element fed from a first feeding point according to a first embodiment of the invention.

FIG. 3 is a diagram for illustrating return loss of the antenna element 11 fed from the first feeding point 121 according to the first embodiment of the invention. In some embodiments, a total area of the ground element 10 is about 15000 $mm^2$ (100 mm by 150 mm) which is about a typical size of a ground element of a tablet computer, and a total area of the antenna element 11 is only about 112 $mm^2$ (8 mm by 14 mm) When the first switch 131 is closed and the second switch 132 is open, the antenna element 11 is fed from the first feeding point 121 and operates in a first band 31. In some embodiments, the first band 31 is approximately from 824 MHz to 960 MHz. In some embodiments, a length of the metal element 12 is smaller than 0.15 wavelength of the lowest frequency in the first band 31.

Figure 4:
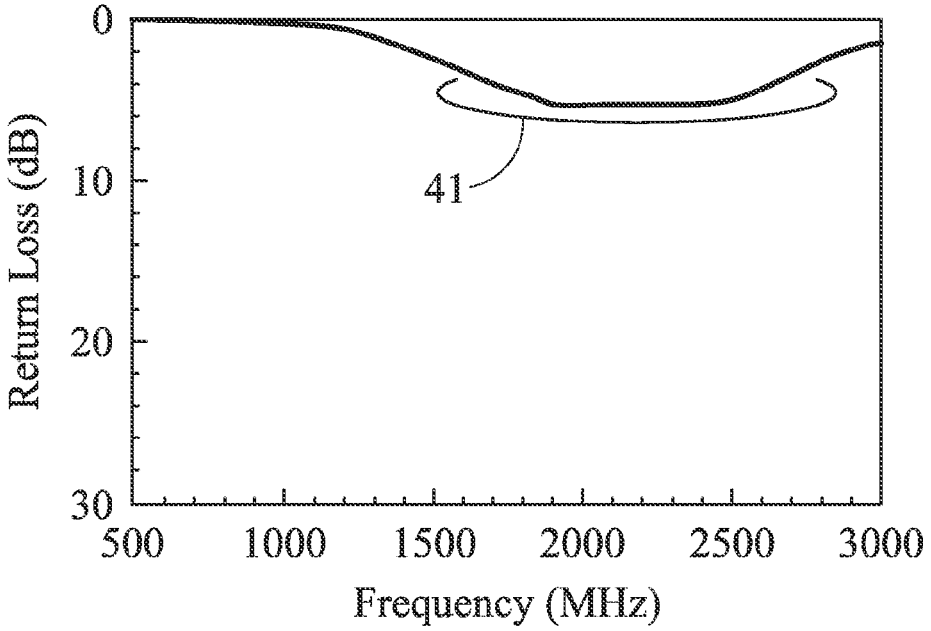
FIG. 4 is a diagram for illustrating return loss of an antenna element fed from a second feeding point according to a first embodiment of the invention.

FIG. 4 is a diagram for illustrating the return loss of the antenna element 11 fed from the second feeding point 122 according to the first embodiment of the invention. When the second switch 132 is closed and the first switch 131 is open, the antenna element 11 is fed from the second feeding point 122 and operates in a second band 41. In some embodiments, frequencies of the second band 41 are higher than frequencies of the first band 31. In some embodiments, the second band 41 is approximately from 1710 MHz to 2690 MHz.

Figure 5:
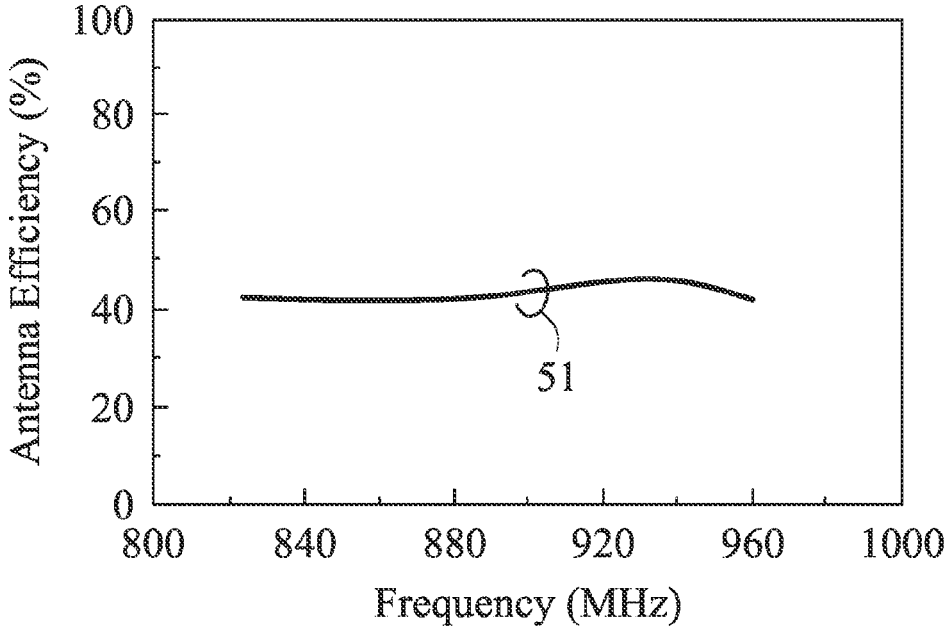
FIG. 5 is a diagram for illustrating antenna efficiency of an antenna element fed from a first feeding point according to a first embodiment of the invention.

FIG. 5 is a diagram for illustrating antenna efficiency of the antenna element 11 fed from the first feeding point 121 according to the first embodiment of the invention. When the first switch 131 is closed and the second switch 132 is open, the antenna efficiency curve 51 represents the antenna efficiency of the antenna element 11 operating in the GSM850/900 bands. As shown in FIG. 5, the antenna efficiency of the antenna element 11 is approximately at least 42% (return losses included) in the GSM850/900 bands, and meets many application requirements.

Figure 6:
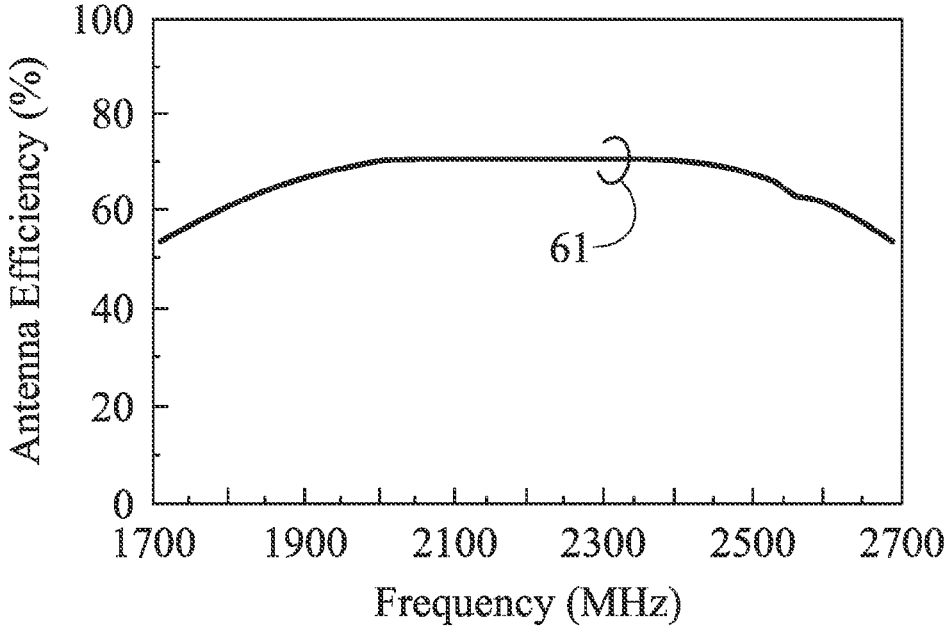
FIG. 6 is a diagram for illustrating antenna efficiency of an antenna element fed from a second feeding point according to a first embodiment of the invention.

FIG. 6 is a diagram for illustrating the antenna efficiency of the antenna element 11 fed from the second feeding point 122 according to the first embodiment of the invention. When the second switch 132 is closed and the first switch 131 is open, the antenna efficiency curve 61 represents the antenna efficiency of the antenna element 11 operating in the GSM1800/1900/UMTS/LTE2300/2500 bands. As shown in FIG. 6, the antenna efficiency of the antenna element 11 is approximately from 55% to 70% (return losses included) in the GSM1800/1900/UMTS/LTE2300/2500 bands, and meets many application requirements.

Figure 7:
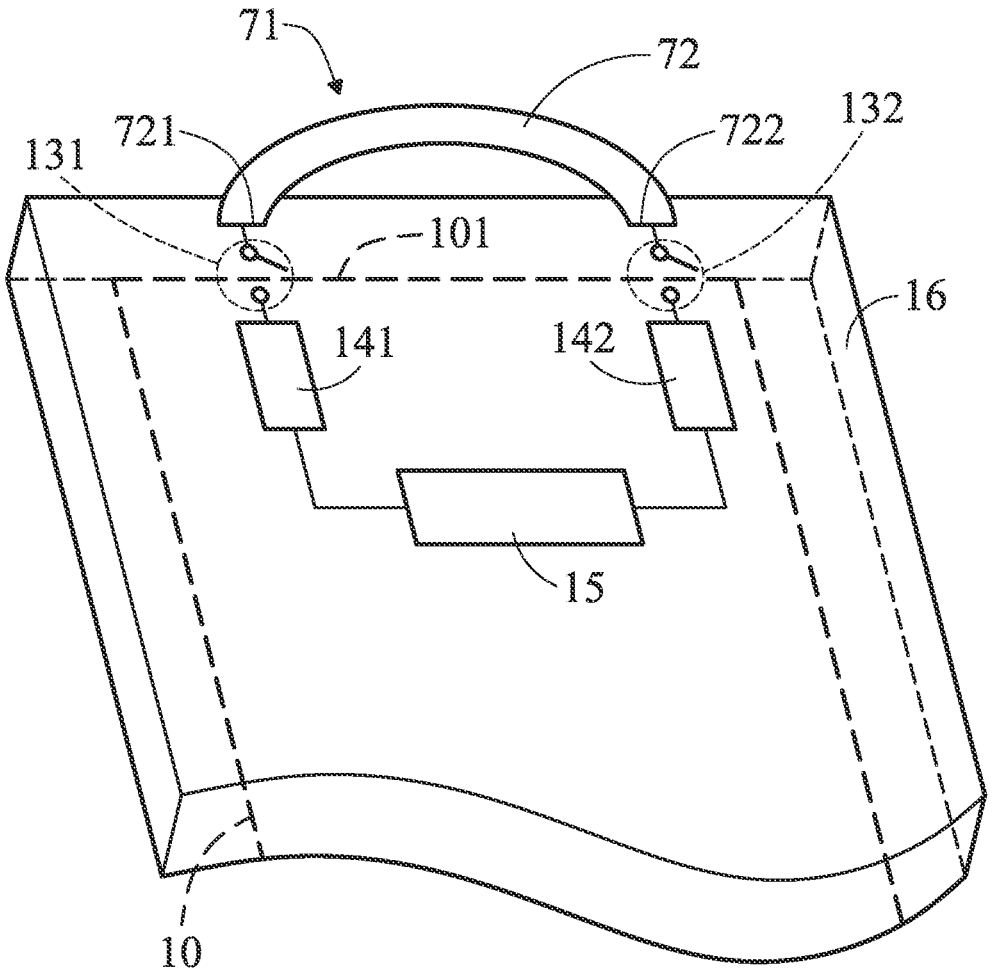
FIG. 7 is a diagram for illustrating a communication device according to a second embodiment of the invention.

FIG. 7 is a diagram for illustrating a communication device 700 according to a second embodiment of the invention. In the second embodiment, a metal element 72 of an antenna element 71 has a smoothly-bent structure and substantially has an inverted C-shape. Other features of the communication device 700 of the second embodiment are similar to those of the communication device 100 of the first embodiment. Accordingly, the two embodiments can achieve similar performances.

Figure 8:
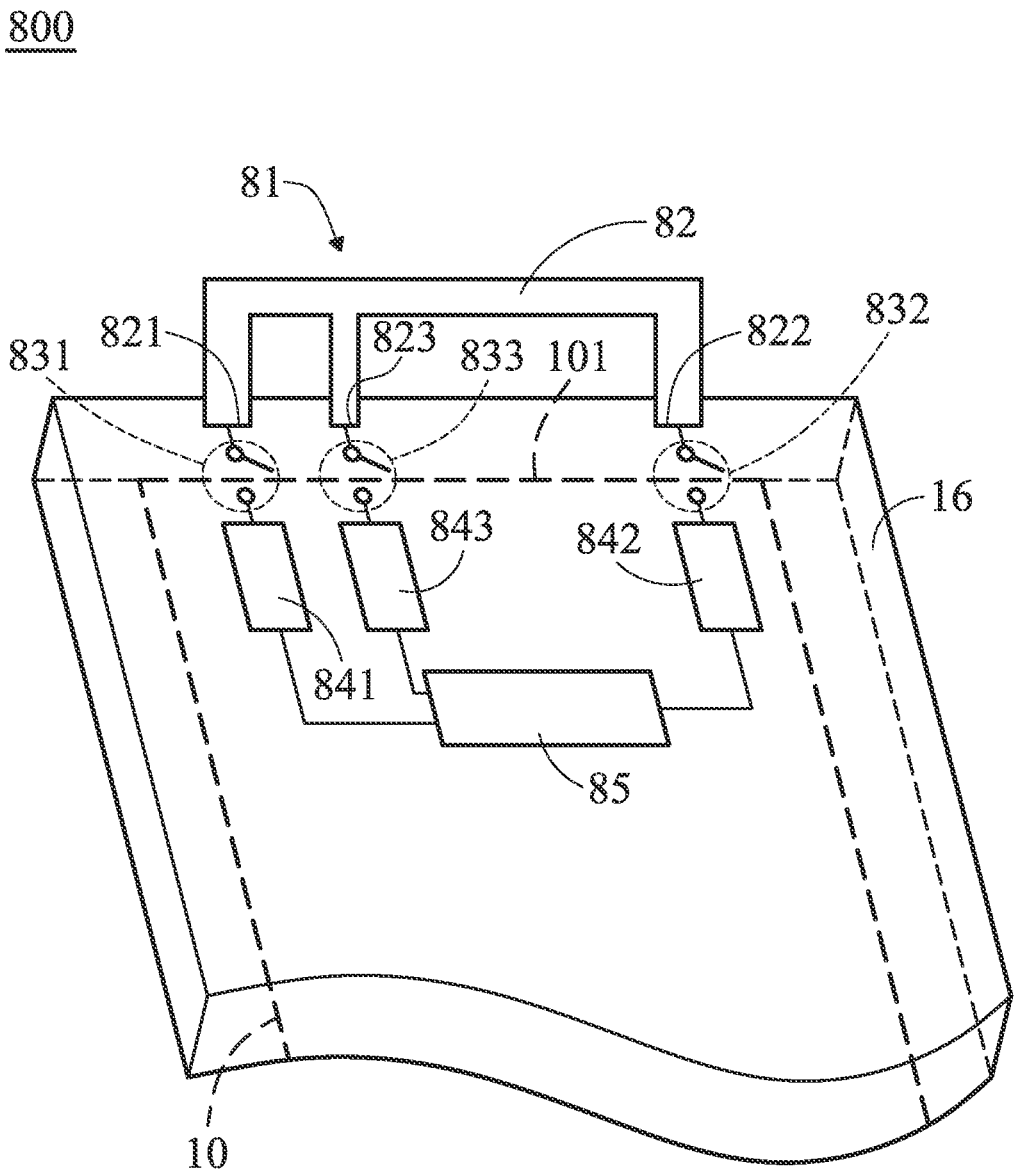
FIG. 8 is a diagram for illustrating a communication device according to a third embodiment of the invention.

FIG. 8 is a diagram for illustrating a communication device 800 according to a third embodiment of the invention. In the third embodiment, an antenna element 81 has a first feeding point 821, a second feeding point 822, and a third feeding point 823. The first feeding point 821 and the second feeding point 822 are away from each other, and are respectively substantially positioned at a first end and a second end of a metal element 82 of the antenna element 81. The third feeding point 823 is positioned between the first feeding point 821 and the second feeding point 822. In some embodiments, the metal element 82 substantially has an inverted E-shape. The third feeding point 823 of the antenna element 81 is coupled through a third switch 833 and a third matching circuit 843 to a communication module 85. In some embodiments, the third switch 833 is implemented with a PIN diode. The third matching circuit 843 provides a third impedance value. The third impedance value may be different from a first impedance value of a first matching circuit 841 and from a second impedance value of a second matching circuit 842. In some embodiments, the third matching circuit 843 comprises one or more inductors and capacitors, such as chip inductors and chip capacitors. When a first switch 831 and a second switch 832 are both open and the third switch 833 is closed, the antenna element 81 is fed from the third feeding point 823 and operates in a third band. Other features of the communication device 800 of the third embodiment are similar to those of the communication device 100 of the first embodiment. Accordingly, the two embodiments can achieve similar performances.

Figure 9:
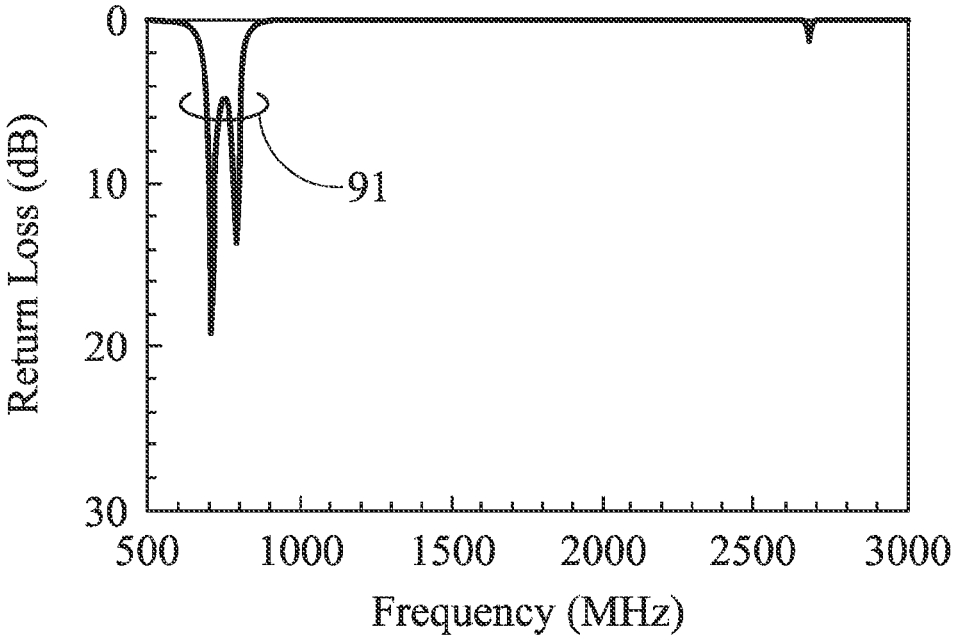
FIG. 9 is a diagram for illustrating return loss of an antenna element fed from a third feeding point according to a third embodiment of the invention.

FIG. 9 is a diagram for illustrating the return loss of the antenna element 81 fed from the third feeding point 823 according to the third embodiment of the invention. When the first switch 831 and the second switch 832 are both open and the third switch 833 is closed, the antenna element 81 is fed from the third feeding point 823 and operates in a third band 91. In some embodiments, the third band 91 is adjacent to the first band 31, or is substantially between the first band 31 and the second band 41. In some embodiments, the third band 91 is approximately from 704 MHz to 787 MHz. Accordingly, in comparison to the above embodiments, the communication device 800 covers more operating bands, such as an LTE700 band.

Figure 10:
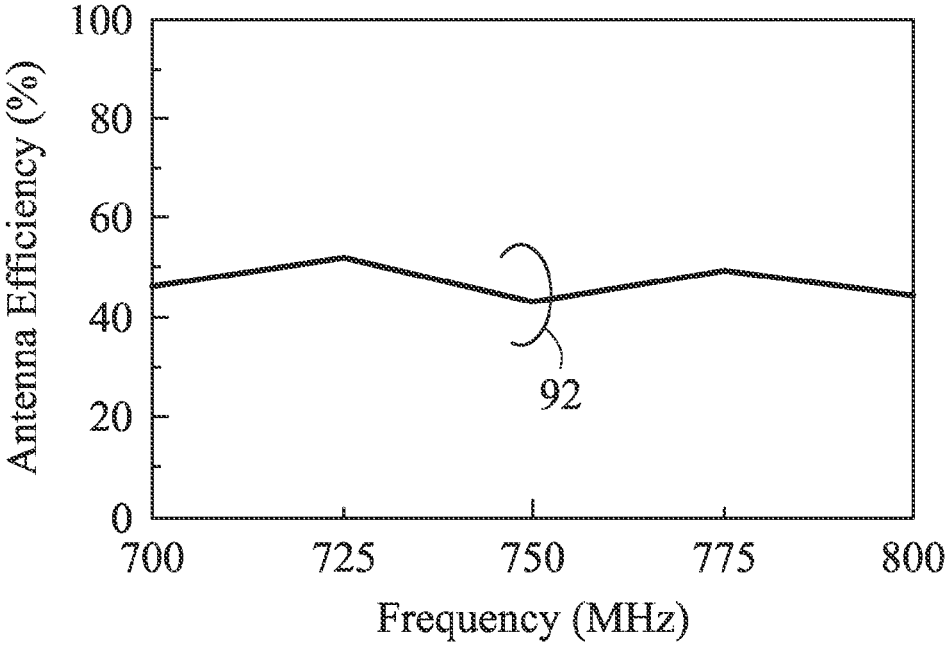
FIG. 10 is a diagram for illustrating antenna efficiency of an antenna element fed from a third feeding point according to a third embodiment of the invention.

FIG. 10 is a diagram for illustrating antenna efficiency of the antenna element 81 fed from the third feeding point 823 according to the third embodiment of the invention. When the first switch 831 and the second switch 832 are both open and the third switch 833 is closed, the antenna efficiency curve 92 represents the antenna efficiency of the antenna element 81 operating in the LTE700 band. As shown in FIG. 10, the antenna efficiency of the antenna element 81 is approximately at least 44% (return losses included) in the LTE700 band, and meets many application requirements.

Note that the above element sizes, element shapes, and frequency ranges are not limitations of the invention. An antenna designer can adjust these setting values according to different requirements.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

It will be apparent to those skilled in the art that various modifications and variations can be made in the invention. It is intended that the standard and examples be considered as exemplary only, with a true scope of the disclosed embodiments being indicated by the following claims and their equivalents.

What is claimed is:

1. A communication device, comprising:

a ground element; and an antenna element, comprising a metal element, wherein the metal element is disposed at or adjacent to an edge of the ground element, the metal element is substantially perpendicular to the ground element, the metal element has a projection on the ground element, the whole projection is in the internal of the ground element, the antenna element has a first feeding point and a second feeding point, the first feeding point and the second feeding point are away from each other and are respectively substantially positioned at a first end and a second end of the metal element, and the first feeding point and the second feeding point are both adjacent to the edge of the ground element, wherein the first feeding point is coupled through a first switch and a first matching circuit to a communication module, and the second feeding point is coupled through a second switch and a second matching circuit to the communication module;

wherein the metal element and the ground element are conductive planar elements that lie in distinct planes, and the distinct planes are perpendicular to each other;

wherein the whole projection of the metal element as seen looking perpendicularly down on a plane in which the ground element lies falls entirely on a surface of the ground element;

wherein the first switch and the first matching circuit are distinct from the second switch and the second matching circuit.

2. The communication device as claimed in claim 1, wherein the metal element has a planar structure and substantially has an inverted U-shape.

3. The communication device as claimed in claim 1, wherein the metal element has a smoothly-bent structure and substantially has an inverted C-shape.

4. The communication device as claimed in claim 1, wherein when the first switch is closed and the second switch is open, the antenna element is fed from the first feeding point, and wherein the first matching circuit provides a first impedance value such that the antenna element operates in a first band.

5. The communication device as claimed in claim 4, wherein a length of the metal element is smaller than 0.15 wavelength of the lowest frequency in the first band.

6. The communication device as claimed in claim 4, wherein when the second switch is closed and the first switch is open, the antenna element is fed from the second feeding point, and wherein the second matching circuit provides a second impedance value such that the antenna element operates in a second band, and frequencies of the second band are higher than frequencies of the first band.

7. The communication device as claimed in claim 6, wherein the first band is approximately from 824 MHz to 960 MHz, and the second band is approximately from 1710 MHz to 2690 MHz.

8. The communication device as claimed in claim 6, wherein the antenna element further has a third feeding point, the third feeding point is positioned between the first feeding point and the second feeding point, and the third feeding point is coupled through a third switch and a third matching circuit to the communication module.

9. The communication device as claimed in claim 8, wherein when the first switch and the second switch are both open and the third switch is closed, the antenna element is fed from the third feeding point, wherein the third matching circuit provides a third impedance value such that the antenna element operates in a third band, and wherein the third band is adjacent to the first band or is between the first band and the second band.

10. The communication device as claimed in claim 9, wherein the third band is approximately from 704 MHz to 787 MHz.

11. The communication device as claimed in claim 1, wherein the ground element is substantially disposed between a metal back cover of the communication device and the metal element of the antenna element.

* * * * *